United States Patent [19]

Scheffee

[11] Patent Number: 4,465,495

[45] Date of Patent: Aug. 14, 1984

[54] PROCESS FOR MAKING COAL-WATER FUEL SLURRIES AND PRODUCT THEREOF

[75] Inventor: Robert S. Scheffee, Lorton, Va.

[73] Assignee: Atlantic Research Corporation, Alexandria, Va.

[21] Appl. No.: 360,523

[22] Filed: Mar. 22, 1982

Related U.S. Application Data

[63] Continuation-in-part of Ser. No. 197,853, Oct. 17, 1980, abandoned.

[51] Int. Cl.[3] ..... C10L 1/32

[52] U.S. Cl. ..... 44/51

[58] Field of Search ..... 44/51; 406/47, 49, 197

[56] References Cited

U.S. PATENT DOCUMENTS

| | | | |
|---|---|---|---|
| 2,346,151 | 4/1944 | Burk et al. | 44/51 |
| 3,948,617 | 4/1976 | Withorn | 44/51 |
| 3,996,026 | 12/1976 | Cole | 44/51 |
| 4,082,516 | 4/1978 | Metzger | 44/51 |
| 4,104,035 | 8/1978 | Cole et al. | 44/51 |
| 4,147,519 | 4/1979 | Sawyer, Jr. | 44/51 |
| 4,261,701 | 4/1981 | Schultz et al. | 44/51 |
| 4,282,006 | 8/1981 | Funk | 44/51 |
| 4,304,572 | 12/1981 | Wiese et al. | 44/51 |

FOREIGN PATENT DOCUMENTS 2727943 5/1978 Fed. Rep. of Germany .

*Primary Examiner*—Y. Harris-Smith

*Attorney, Agent, or Firm*—Martha L. Ross

[57] ABSTRACT

A process for making fluid, stable slurries of finely divided coal in water and products thereof, which can be sufficiently highly loaded to serve as a fuel.

66 Claims, No Drawings

PROCESS FOR MAKING COAL-WATER FUEL SLURRIES AND PRODUCT THEREOF

RELATED APPLICATIONS

This application is a continuation-in-part of copending application Ser. No. 197,853, filed Oct. 17, 1980, now abandoned.

BACKGROUND

A high fuel value coal-water slurry which can be injected directly into a furnace as a combustible fuel, can supplant large quantities of increasingly expensive fuel oil presently being used by utilities, factories, ships, and other commercial enterprises. Since the inert water vehicle reduces fuel value in terms of BTU/lb, it is desirable to minimize its concentration and maximize coal concentration for efficient use of the slurry as a fuel. High coal content also improves the combustion characteristics of the slurry.

It is important, therefore, that the slurry be loadable with finely divided coal in amounts as high, for example, as about 50% to 70% of the slurry. Despite such high solids loading, the slurry must be sufficiently fluid to be pumped and sprayed into the furnace. The coal particles must also be uniformly dispersed. The fluidity and dispersion must be stably maintained during storage.

SUMMARY

Fluid, pourable slurries comprising up to about 70% or higher of coal stably dispersed in water are produced by admixing finely-divided coal having a critical distribution of particle sizes, water, and an organic dispersant in a high shear rate mixer. An inorganic buffer salt may also be added. The term "fluid" as employed in this specification and claims means a slurry which is fluid and pourable both at rest and in motion or a slurry which gels or flocculates into a substantially non-pourable composition at rest and becomes pourably fluid with stirring or other application of relatively low shear stress.

Controlled distribution of coal particles sizes is essential for both fluidity and stability. The particle size mixture, necessary for fluidity of the highly loaded slurry, comprises ultrafine (UF) particles having a maximum size of up to about 10 μMMD (mass median diameter), preferably about 1μ to 8 μMMD and larger particles hereafter defined as (F/C), having a size range of about 20μ to 200 μMMD, preferably about 20μ to 150 μMMD. For stability of the slurry, the UF particles should comprise about 10 to 50% by wt of the slurry, preferably about 10 to 30% and more particularly 15 to 25%.

The actual degree of coal loading is not critical and will vary with the given use and operating equipment. The concentration of coal successfuly incorporated into a given slurry varies with such factors as the relative amounts of UF and F/C particles, size of the F/C particles used within the effective range, and the like. In general, percentage loading increases with increasing F/C size. An organic dispersant is essential to maintain the coal particles in stable dispersion. It has been found that the highly-loaded slurries are very sensitive to the particular type of surfactant used, especially with respect to fluidity and storageability. The dispersants which have proven to be effective in producing stable fluid mixes are high molecular weight alkaline earth metal (e.g. Ca, Mg) organosulfonates in which the organic moiety is polyfunctional. Molecular weight of the organosulfonate is desirably about 1,000 to 25,000. The surfactant is used in minor amount, e.g. about 0.5 to 5 pph of coal, preferably about 1 to 2 pph.

In some cases, particularly at higher coal loadings, it has been found desirable to add an inorganic, alkali metal (e.g. Na, K) buffer salt to stabilize pH of the slurry in the range of about pH 5 to 8, preferably about pH 6 to 7.5. The salt improves aging stability, pourability and handling characteristics of the slurry. It may be that the buffer counteracts potentially adverse effects of acid leachates from the coal. The salt, such as sodium or potassium phosphate or carbonate, including their acid salts, is used in minor amounts sufficient to provide the desired pH, e.g. abut 0.1 to 2% based on the water. The inorganic salts also serve to reduce gaseous sulfur pollutants by forming non-gaseous sulfur compounds.

The ultrafine and larger F/C coal particles, water, dispersant, and inorganic salt components are mixed in a blender or other mixing device which can deliver high shear rates. High shear mixing, e.g. at shear rates of at least about 100 $sec^{-1}$, preferably at least about 500 $sec^{-1}$, is essential for producing a stable slurry free from substantial sedimentation. The use of high shear mixing and the dispersant appears to have a synergistic effect. Dispersant with low shear mixing results in an extremely viscous, non-pourable slurry, while high shear mixing without dispersant produces a slurry which is unstable towards settling. With both dispersant and high shear mixing a fluid, pourable, stable slurry can be obtained.

The slurries are viscous, fluid dispersions which can generally be characterized as thixotropic or Bingham fluids having a yield point. In some cases, the slurries may gel or flocculate when at rest into substantially non-pourable compositions but are easily rendered fluid by stirring or other application of relatively low shear stress. They can be stored for considerable periods of time without excessive settling or sedimentation. The slurries can be employed as fuels by injection directly into a furnace previously brought up to ignition temperature of the slurry. The finely divided state of the coal particles improves combustion efficiency. Since the dispersants are organic compounds, they may be biodegraded with time. This can readily be prevented by addition of a small amount of biocides.

DETAILED DESCRIPTION

The ultrafine coal particles can be made in any suitable device, such as a ball mill or attritor, which is capable of very fine comminution. Preferably, though not essentially, the coal is milled with water so that the UF particles are in water slurry when introduced into the mixer. Some of the dispersant can be included, if desired, in the UF milling operation to improve flow and dispersion characteristics of the UF slurry.

The required larger size coal particles (20μ to 200 μMMD) can be made from crushed coal in a comminuting device such as a hammermill equipped with a grate having appropriately sized openings. Excessively sized coal residue can be used for making the UF particles.

The coal concentrations as used in the specification and in the following examples is on a dried coal basis which normally equals 98.5% by weight of bone dried coal.

3.6 μMMD UF particles employed in Examples 3–8 were prepared in accordance with Example 1 and the UF particles were introduced in the form of the Example 1 aqueous slurry containing a portion of the dispersant. The total amount of dispersant given in the Examples includes the portion introduced in this way.

34 μMMD and 110 μMMD particles used in Examples 3–9 were prepared in accordance with Example 2.

Sedimentation measurement, which is based on Stoke's Law giving the relationship between particle size and settling velocity, was used experimentally in all cases to determine sub-sieve particle sizes. The particular sedimentation technique employed is one conventionally known as centrifugal sedimentation. The sedimentometer used was the MSA Particle Size Analyzer (C. F. Casello & Co. Regent House, Britania Walk, London NI). In centrifugal sedimentation, the local acceleration due to gravity, g, is multipled by $\omega^2$ r/g where $\omega$ is rotational velocity and r is radius of rotation. The "two layer" method was used in the experimental procedures. All of the coal powder is initially concentrated in a thin layer floating on top of the suspending water fluid in a centrifuge tube. The fluid is centrifuged at incrementally increasing rotational speeds. The amount of sedimenting powder is measured as a function of time at a specified distance from the surface of the fluid. The cummulative size distribution was determined by plotting the fractional weights settled out against the free-falling Stoke's diameter. Thus sub-sieve particle sizes disclosed and claimed herein were obtained by sedimentation measurement.

EXAMPLE 1

50% by wt crushed coal, 1% calcium lignosulfonate (Marasperse C-21) and 49% water were ball milled for 2 hours. The size of the resulting UF coal particles was 3.6 μMMD. The UF coal-water slurry was fluid and pourable.

EXAMPLE 2

A. Crushed coal was comminuted in a hammermill at 3,450 RPM with a 27 HB grate. The particle size of the product was 110 μMMD.

B. Crushed coal was comminuted in a hammermill at 13,800 RPM with a 10 HB grate. The particle size of the resulting product was 34 μMMD.

EXAMPLE 3

A. 65% by wt of coal comprising 55% 110 μMMD coal and 45% 3.6 μMMD coal, 1.3% Marasperse C-21 (calcium lignin sulfonate, Ca content as CaO 5.2%, Na content as $Na_2O$ 6.1%, Mg content as MgO 0.3%) and 33.7% water were mixed in a blender at 6,000 RPM at a shear rate of 1,000 $sec^{-1}$. The resulting slurry was paint-like and set into a soft gel which was easily stirred to a liquid. After 23 days, it exhibited no sedimentation and was easily restirrable to a uniform dispersion havig relatively low viscosity of 6.7 p.

B. A mix was made identical to A except that 34 μMMD particles were substituted for the UF particles. The mix, though initially fluid was unstable. Within 3 days it separated, forming a large supernatent and a highly packed subsidence. It could not be remixed into a uniform, pourable dispersion.

EXAMPLE 4

A. A 65% coal slurry comprising 15% 3.6 μMMD and 50% 34 μMMD particles by wt. of the slurry, 1.3% Marasperse C-21 and 33.7% water were mixed in a blender at 6000 RPM. The resulting product was a uniformly dispersed gel which after 12 days in storage exhibited no supernatant, subsidence or sedimentation. The gel was non-pourable at rest and became a pourable fluid with stirring.

B. A mix was made identical to A except that the blender was run at a low shear rate of 60 RPM (10 $sec^{-1}$). The resulting slurry was unstable. Within 4 days it had separated into liquid and aggregated sediment.

EXAMPLE 5

A. A 65% coal slurry comprising 26% 3.6 μMMD particles and 39% 110 μMMD particles, 1.3% Marasperse C-21 and 33.7% water were mixed in a blender at 6,000 RPM. The resulting product was a uniformily dispersed slurry which was fluid and pourable and after 10 days was still pourable and substantially free from subsidence or sedimentation.

B. A mix was made identical to A except that the blender was run at a low shear rate of 10 $sec^{-1}$. The resulting slurry was unstable. Within 3 days it had separated into supernatant and aggregated sediment.

EXAMPLE 6

A 65% coal slurry was made identical to Example 3A except that no dispersant was added. The resulting product had the consistency of a stiff grease.

EXAMPLE 7

A. A 70% coal slurry comprising 45.5% 110 μMMD particles and 24.5% 3.6 μMMD particles. 1.4% Marasperse C-21, and 28.6% water solution buffered to pH 7 by 0.15% $Na_2HPO_4$ added in the blender was mixed at 6,000 RPM. The resulting slurry has a EOM viscosity of 1.48 Kp, is fluid and pourable. After 7 days in storage it exhibited no supernatant liquid, settling or aggregation.

B. A mix was made identical to A except that phosphate salt was not added. The resulting slurry set up into a stiff non-pourable mass within 3 days.

C. A mix identical to A, except that the buffer salt was added to the ball mill producing the UF particles and was run in a blender at the low shear rate of 60 RPM (10 $sec^{-1}$). The slurry was unstable and within 5 days separated into supernatant and stiff aggregated sediment.

EXAMPLE 8

A mix was made identical to Example 4A except that $Na_2HPo_4$ in amount providing buffered pH 7 was added in the blender. The resulting slurry was fluid and pourable. Its viscosity was EOM-T bar 0.92 Kp. It retained its stability and pourability during storage and after 12 days was free from separation.

EXAMPLE 9

A. 30 wt% of hammermilled coal fines (30 μMMD), 0.3% Marasperse C-21 (1 pph coal), and 69.7% water were milled in an attritor for 30 min. The resulting slurry was very fluid. The UF coal particle size was 3.88 μMMD.

B. A 65 wt% coal slurry comprising 50 wt% 34 MMD coal particles, 15 wt%, 3.88 μMMD (using 50 wt% of slurry from 9A supra), 2 pph on coal of Marasperse C-21, and the remainder water, was mixed in a blender at a shear rate of 6,000 RPM (1000 $sec^{-1}$). The product was uniformly-dispersed, pourable slurry. After 56 days the slurry was a stable, non-pourable gel free from settling or sedimentation. There was a very slight supernatant, probably caused by water evaporation and condensation on the surface. The thixotropic gel became easily pourable with slight stirring. At rest it returned to a stable non-pourable state within a short time.

After 61 days it retained its stable characteristics after several stirrings to pourability.

C. A slurry similar to 9B was prepared except that the mix was buffered to pH 7 by the addition of $Na_2HP_4$. The product was a uniformly-dispersed fluid slurry of relatively low viscosity. After 55 days the slurry was a weak, non-pourable gel free from settling or sedimentation. As in 9B there was a very slight supernatant. With slight stirring, it became very fluid and pourable. It was still stable and pourable after 24 hours and, although some what more viscous, retained its stability and pourability 5 days after the initial stirring.

EXAMPLE 10

The ultrafine 3.6 μMMD coal component was made in accordance with Example 1. A 110 μMMD coal component was prepared as in Example 2.

A 65% coal slurry comprising 32.5% 3.6 μMMD and 32.5% 110 μMMD coal particles by wt of the slurry, 0.65% Marasperse C-21, and 34.35% water, was prepared in a high speed bender at 6000 rpm (shear rate approximately 1000 $sec^{-1}$). The resulting slurry was a soft thixotropic gel with a yield point of 49 dynes/$cm^2$. With light stirring to overcome the yield point, the slurry was fluid and pourable. It had a Brookfield viscosity of 1,440 cp at 60 rpm. After 14 days the slurry was still substantially uniformly dispersed. It had a slight supernatent, was free of hard-packed sediment, and could easily be stirred to uniformity and pourability.

EXAMPLE 11

The 3.6 μMMD ultrafine coal component was made in accordance with Example 1, except that 1% Lomar UDG, a calcium naphthalene sulfonate containing 11.5% Ca as $CaSO_4$, was substituted for the Marasperse C-21. A 110 μMMD coal component was prepared as in Example 2.

A 65% coal slurry, comprising 32.5% 3.6 μMMD and 32.5% 110 μMMD coal particles by wt of the slurry, 0.65% Lomar UDG, and 34.35% water, was prepared in a high speed blender at 6000 rpm. The resulting slurry was a soft thixotropic gel with a yield point of 30 dynes/$cm^2$. With light stirring to overcome the yield point, the slurry was fluid and pourable. It had a Brookfield viscosity of 1,915 cp at 60 rpm. After 14 days, the slurry was still substantially uniformly dispersed. It had a slight supernatent, was free of hard-packed sediment, and could easily be stirred to uniformity and pourability.

EXAMPLE 12

The ultrafine 3.6 μMMD coal component was prepared by mixing 60 wt% coal with 0.6% Marasperse C-21, 0.28% $Na_2HPO_4$, and 39.12% water and ball milling for 2 hours as in Example 1. The phosphate buffer salt was included to facilitate the grinding. A 110 μMMD coal fraction was prepared by hammermilling as in Example 2.

A 65% coal slurry comprising 50% 3.6 μMMD and 15% 110 μMMD coal particles by wt of the slurry, Marasperse C-21 0.65%, 0.23% $Na_2HPO_4$, and 34.12% water was prepared in a high speed blender at 6000 rpm. The resulting slurry was a uniformly dispersed thixotropic gel after 5 days which became fluid and pourable with light stirring.

Example 3 demonstrates the need for the UF particles in controlled size distribution to impart stability. Examples 4 and 5 show the need for high shear rate mixing. Example 6 shows the importance of the dispersant. Example 7 illustrates the improvement made in a highly-loaded 70% slurry by use of an inorganic buffer salt and the adverse effect of low shear mixing. Example 8 shows that the use of the pH buffer salt maintained the slurry in a stable fluid condition. Example 9 shows that the buffer salt improved aging and its user and handling characteristics.

The stable, fluid coal-water slurries are efficient and considerably lower cost alternatives to fuel oil. Their flame temperatures and heating values compare very favorably with fuel oil, as is shown in the following tables:

TABLE I

| ADIABATIC FLAME TEMPERATURE AT 20% EXCESS AIR* | |
|---|---|
| #6 Fuel Oil | 3095° F. |
| 70% coal-water slurry | 3089° F. |
| 65% coal-water slurry | 3028° F. |

*in a typical furnace

TABLE II

| HEATING VALUE IN BTU/lb OF COMBUSTION PRODUCTS | |
|---|---|
| #6 fuel oil | 991.0 |
| 70% Coal-water slurry | 983.3 |
| 65% coal-water slurry | 975.5 |

TABLE III

| COST PER MILLION BTU | |
|---|---|
| #6 fuel oil | $4.94 |
| 70% coal-water slurry | $2.24 |
| 65% coal-water slurry | $2.34 |

I claim:

1. Process for making substantially stable coal-water slurries comprising:
   a. Admixing:
      (i) ultrafine coal particles having a maximum size of about 10 μMMD in an amount comprising about 10 to 50% by weight of the slurry,
      (ii) larger coal particles within the size range of about 20% to 200 μMMD in an amount sufficient to provide a desired total coal concentration in the slurry
      (iii) water in an amount sufficient to provide the water carrier component of said slurry, and
      (iv) a minor amount of dispersant sufficient to maintain the coal particles in stable dispersion, said dispersant consisting essentially of alkaline earth metal salt of organo-sulfonate in which the organic moiety is multi-functional, and
   b. subjecting the mixture to mixing at a shear rate of at least about 100 $sec^{-1}$.

2. Process of claim 1 in which the ultrafine particles comprise about 10 to 30% by weight of the slurry.

3. Process of claim 1 in which:
   a. the ultrafine particles are within a size range of about 1 to 8 μMMD, and, b. the larger coal particles are within the size range of about 20 to 150 μMMD.

4. Process of claim 2 in which:

a. the ultrafine particles are within a size range of about 1 to 8 μMMD, and b. the larger coal particles are within the size range of about 20 to 150 μMMD.

5. Process of claim 1 in which the dispersant is calcium lignosulfonate.

6. Process of claim 2 in which the dispersant is calcium lignosulfonate.

7. Process of claim 3 in which the dispersant is calcium lignosulfonate.

8. Process of claim 4 in which the dispersant is calcium lignosulfonate.

9. Process of claim 1 in which the minimum shear rate is about 500 $sec^{-1}$.

10. Process of claim 2 in which the minimum shear rate is about 500 $sec^{-1}$.

11. Process of claim 3 in which the minimum shear rate is about 500 $sec^{-1}$.

12. Process of claim 4 in which the minimum shear rate is about 500 $sec^{-1}$.

13. Process of claim 5 in which the minimum shear rate is about 500 $sec^{-1}$.

14. Process of claim 6 in which the minimum shear rate is about 500 $sec^{-1}$.

15. Process of claim 1 in which the ultrafine particles are produced in the presence of water and at least a portion of the dispersant.

16. Process of claim 2 in which the ultrafine particles are produced in the presence of water and at least a portion of the dispersant.

17. Process of claim 3 in which the ultrafine particles are produced in the presence of water and at least a portion of the dispersant.

18. Process of claim 4 in which the ultrafine particles are produced in the presence of water and at least a portion of the dispersant.

19. Process of claim 5 in which the ultrafine particles are produced in the presence of water and at least a portion of the dispersant.

20. Process of claim 6 in which the ultrafine particles are produced in the presence of water and at least a portion of the dispersant.

21. Process of claim 9 in which the ultrafine particles are produced in the presence of water and at least a portion of the dispersant.

22. Process of claim 10 in which the ultrafine particles are produced in the presence of water and at least a portion of the dispersant.

23. Process of claim 1 in which an inorganic alkali metal buffer salt is added to maintain pH in the range of about 5 to 8.

24. Process of claim 2 in which an inorganic alkali metal buffer salt is added to maintain pH in the range of about 5 to 8.

25. Process of claim 15 in which an inorganic alkali metal buffer salt is added to maintain pH in the range of about 5 to 8.

26. Process of claim 16 in which an inorganic alkali metal buffer salt is added to maintain pH in the range of about 5 to 8.

27. Process of claim 17 in which an inorganic alkali metal buffer salt is added to maintain pH in the range of about 5 to 8.

28. Process of claim 18 in which an inorganic alkali metal buffer salt is added to maintain pH in the range of about 5 to 8.

29. Process of claim 19 in which an inorganic alkali metal buffer salt is added to maintain pH in the range of about 5 to 8.

30. Process of claim 20 in which an inorganic alkali metal buffer salt is added to maintain pH in the range of about 5 to 8.

31. Process of claim 21 in which an inorganic alkali metal buffer salt is added to maintain pH in the range of about 5 to 8.

32. Process of claim 22 in which an inorganic alkali metal buffer salt is added to maintain pH in the range of about 5 to 8.

33. Process of claim 23 in which the buffer salt is an alkali metal phosphate.

34. Process of claim 24 in which the buffer salt is an alkali metal phosphate.

35. Process of claim 25 in which the buffer salt is an alkali metal phosphate.

36. Process of claim 26 in which the buffer salt is an alkali metal phosphate.

37. Process of claim 27 in which the buffer salt is an alkali metal phosphate.

38. Process of claim 28 in which the buffer salt is an alkali metal phosphate.

39. Process of claim 29 in which the buffer salt is an alkali metal phosphate.

40. Process of claim 30 in which the buffer salt is an alkali metal phosphate.

41. Process of claim 31 in which the buffer salt is an alkali metal phsopahte.

42. Process of claim 32 in which the buffer salt is an alkali metal phosphate.

43. A coal-water slurry which comprises:

a. ultrafine coal particles having a maximum size of about 10 μMMD, in an amount comprising about 10 to 50% by weight of slurry;

b. larger coal particles within the size range of about 20 to 200 μMMD in an amount sufficient to provide a desired total coal concentration in the slurry;

c. water in an amount sufficient to provide the water carrier component of the slurry; and d. a minor amount of a dispersant sufficient to maintain the coal particles in stable dispersion, said dispersant consisting essentially of an alkaline earth metal organo-sulfonate in which the organic moiety is multifunctional.

44. The slurry of claim 43 in which the ultrafine particles comprise about 10 to 30% by weight of the slurry.

45. The slurry of claim 43 in which:

a. the ultrafine particles are within a size range of about 1 to 8 μMMD; and b. the larger coal particles are within the size range of about 20 to 150 μMMD.

46. The slurry of claim 44 in which:

a. the ultrafine particles are within a size range of about 1 to 8 μMMD; and b. the larger coal particles are within the size range of about 20 to 150 μMMD.

47. The slurry of claim 43 in which the dispersant is calcium lignosulfonate.

48. The slurry of claim 44 in which the dispersant is calcium lignosulfonate.

49. The slurry of claim 43 which is buffered to a pH of about 5 to 8 by means of an added inorganic alkali metal buffer salt.

50. The slurry of claim 44 which is buffered to a pH of about 5 to 8 by means of an added inorganic alkali metal buffer salt.

51. The slurry of claim 47 which is buffered to a pH of about 5 to 8 by means of an added inorganic alkali metal buffer salt.

52. The slurry of claim 48 which is buffered to a pH of about 5 to 8 by means of an added inorganic alkali metal buffer salt.

53. The slurry of claim 49 in which the buffer salt is a phosphate.

54. The slurry of claim 50 in which the buffer salt is a phosphate.

55. The slurry of claim 51 in which the buffer salt is a phosphate.

56. The slurry of claim 5 in which the buffer salt is a phosphate.

57. The slurry of claim 43 in which the slurry is a substantially thixotropic or Bingham fluid.

58. The slurry of claim 44 in which the slurry is a substantially thixotropic or Bingham fluid.

59. The slurry of claim 45 in which the slurry is a substantially thixotropic or Bingham fluid.

60. The slurry of claim 46 in which the slurry is a substantially thixotropic or Bingham fluid.

61. The slurry of claim 47 in which the slurry is a substantially thixotropic or Bingham fluid.

62. The slurry of claim 48 in which the slurry is a substantially thixotropic or Bingham fluid.

63. Process of claim 1 in which sub-sieve particle sizes are defined in terms of those obtainable by sedimentation measurement employing Stoke's Law.

64. Process of claim 2 in which sub-sieve particle sizes are defined in terms of those obtainable by sedimentation measurement employing Stoke's Law.

65. The slurry of claim 43 in which sub-sieve particle sizes are defined in terms of those obtainable by sedimentation measurement employing Stoke's Law.

66. The slurry of claim 44 in which sub-sieve particle sizes are defined in terms of those obtainable by sedimentation measurement employing Stoke's Law.

* * * * *